United States Patent [19]

Prono

[11] Patent Number: 4,507,589

[45] Date of Patent: Mar. 26, 1985

[54] LOW PRESSURE SPARK GAP TRIGGERED BY AN ION DIODE

[75] Inventor: Daniel S. Prono, Livermore, Calif.

[73] Assignee: The United States of America as represented by the United States Department of Energy, Washington, D.C.

[21] Appl. No.: 413,639

[22] Filed: Aug. 31, 1982

[51] Int. Cl.[3] ..... H01J 7/24; H05B 31/26

[52] U.S. Cl. ..... 315/111.01; 313/231.01; 313/601; 200/144 B; 315/111.81

[58] Field of Search ..... 315/111.01, 111.81, 315/108–110; 313/231.01, 577, 601–603; 200/144 B; 328/59

[56] References Cited

U.S. PATENT DOCUMENTS

| | | | |
|---|---|---|---|
| 3,714,510 | 1/1973 | Hofmann | 315/267 X |
| 3,890,520 | 6/1975 | Lutz et al. | 313/157 |
| 3,949,260 | 4/1976 | Bayless et al. | 313/603 X |

OTHER PUBLICATIONS

Faltens et al., *High Repetition Rate Burst-Mode Spark Gap,* Lawrence Livermore National Laboratory, Paper No. UCRL-80934, Jun. 15, 1978.

Lauer et al., *Low Pressure Spark Gap,* Lawrence Livermore National Laboratory, Paper No. UCRL-85739, May 28, 1981.

*Primary Examiner*—Saxfield Chatmon

*Attorney, Agent, or Firm*—Shyamala Rajender; Clifton E. Clouse, Jr.; Judson R. Hightower

[57] ABSTRACT

Spark gap apparatus for use as an electric switch operating at high voltage, high current and high repetition rate. Mounted inside a housing are an anode, cathode and ion plate. An ionizable fluid is pumped through the chamber of the housing. A pulse of current to the ion plate causes ions to be emitted by the ion plate, which ions move into and ionize the fluid. Electric current supplied to the anode discharges through the ionized fluid and flows to the cathode. Current stops flowing when the current source has been drained. The ionized fluid recombines into its initial dielectric ionizable state. The switch is now open and ready for another cycle.

8 Claims, 3 Drawing Figures

LOW PRESSURE SPARK GAP TRIGGERED BY AN ION DIODE

The Government of the United States of America has rights in this invention pursuant to Department of Energy Contract W-7405-ENG-48 between the U.S. Department of Energy and the University of California for the operation of Lawrence Livermore National Laboratory.

FIELD OF THE INVENTION

This invention relates generally to electric spark gaps, and more particularly to spark gaps which operate at high current levels in a low vacuum pressure chamber, wherein positive ions are used to ionize a seed gas through which an electric current flows.

BACKGROUND OF THE INVENTION

In certain electrical circuits, it is desirable to have a high repetition rate spark gap to operate as a switch for high currents flowing in the electric circuit. Most spark gaps have the common features of a housing defining a vacuum chamber in which is mounted a post-like central anode electrode, separated across a gap and electrically insulated from a concentric cylindrical cathode. Concentrically outside these two is a cylindrical housing to which a base is attached to form a chamber. The anode is mounted in the base. An electrically neutral seed gas, also sometimes referred to as a fuel gas, fills the gap between the anode and cathode. This electrically neutral seed gas is ionized during operation, thereby permitting an electric current to flow from the anode through the ionized gas to the chamber wall. This spark gap "switch" is returned to its "open" position either by permitting the ionized seed gas to recombine back into its initial electrically neutral state, or by removing the seed gas left in the chamber and introducing a new charge of gas. It is desirable for spark gaps to have a high repetition rate (rep rate) so they can be fired many times per second, on the order of $10^4$ times per second.

Two general categories of spark gaps now in use are the high pressure spark gap (HPSG) operating at pressures in the range of one (1) to one hundred (100) psi, and the low pressure spark gap (LPSG) operating at vacuum pressures on the order of 100 microns or less. These spark gaps are "conventional" in the sense that they use electrons as the ionizing atomic particle species to ionize the seed gas placed in the spark gap.

In the conventional high pressure spark gaps presently in use, an electron trigger source is used to ionize the neutral seed gas. As shown in FIG. 3 and discussed in more detail below, electrons efficiently ionize gas molecules when the electric energy of the electrons are equivalent to approximately 100 volts. By definition, the high pressure spark gaps contain a densely compressed electrically neutral seed gas with densities on the order of $10^{20}$ atomic particles per cubic centimeter. Therefore, there are many neutral seed gas molecules with which the electrons can collide. The electrons in fact do undergo many collisions with the seed gas molecules, and lose all their energy with each collision. It takes only one collision between an electron and a seed gas molecule for the electron to lose all its energy to the molecule. Hence, even if many hundreds of kilovolts are applied in creating the electric potential across the anode and cathode, the electrons never completely exceed the 100-volt energy associated with optimum ionizations.

These rapid and frequent electron-seed gas molecule collisions cause the seed gas to ionize very quickly, on the order of one (1) nanosecond. This is favorable from the standpoint that the spark gap "closes" very quickly; that is, the seed gas ionizes quickly to be capable of conducting an electric current from the anode to the cathode. However, the same physical collisional processes which provide a favorable ionization rate serve as a detriment to "opening" the switch; that is, the high density of the seed gas and the frequent electron-seed gas molecule collisions make it difficult for the ionized seed gas to recombine into its initial electrically neutral state. Therefore, to "open" the HPSG switch, it has been the practice to remove the high pressure ionized gas by connecting the chamber to vacuum pumps. After these pumps remove the high pressure ionized gas, a fresh charge of electrically neutral seed gas is then injected into the chamber for re-ionization.

Typical pressures in the high pressure spark gap are in the range of one (1) to one hundred (100) psi. Such pressures have the disadvantage of placing a high pumping requirement on the vacuum pumping system, thus requiring cumbersome pumping installations with pumps having capacities in the range of greater than 3000 cubic feet per minute (cfm) at 150 psig. An additional disadvantage is that the heavy pumping requirement severely limits the repetition rate of the switch; it can only fire at an upper rate of $10^3$ times per second.

Many pulsed power devices make use of spark gap switches to suddenly close the electrical circuit of transmission lines charged by voltage. For example, the Experimental Test Accelerator (ETA) electron beam accelerator at the Lawrence Livermore National Laboratory uses Blumlein transmission lines at about 5 ohms characteristic impedance charged to 250 kV. The switch current is 50 kA, and 25 kA 50 ns current pulses are delivered to the electromagnetic induction accelerating units. High gas pressure triggered spark gap switches are used in the ETA. The seed gas is nitrogen with the addition of 8% $SF_6$; the seed gas pressure is approximately 8 atmospheres.

Conventional low pressure spark gaps (LPSG) have the inverse problem. As its name implies, the low pressure spark gap has a low seed gas pressure, typically in the range of several tens to several hundred microns. The LPSG therefore has a low gas density, typically five orders of magnitude (i.e., $10^5$) less than the pressure found in the high pressure spark gap. Because there is low pressure, there is also a low density of seed gas molecules. Thus the electrons traveling between the anode and cathode undergo relatively few collisions with the seed gas molecules; the electrons are accelerated up to high kinetic energies due to the voltage between the electrodes.

As the electrons "run away" in their acceleration to high energy levels (on the order of several tens of kilovolts), their ability to ionize the seed gas drops sharply, resulting in a seriously degraded ionization rate. As a result, the low pressure spark gap switch closes poorly because of the low population density of ionized seed gas. This has the unfortunate consequence of creating a slow current rise (on the order of several tens of nanoseconds). However, the positive aspect of the degraded ionization rate is that the rapid electron mobility allows for very quick recombination of the ionized gas back into an electrically neutral gas. Thus the low pressure spark gap has quick recovery time, meaning that the switch re-opens quickly upon removal of the energy which ionizes the seed gas. There is no requirement for extensive pumping systems as is found in the high pressure spark gap, and there is no close limit on the repetition rate. "Close limit" as used here is defined as the time it takes the seed gas to recombine and the switch to recover to be ready for another firing of rapidly pulsed current. It is desirable to have a recombination time (i.e., close limit) of fractions of a microsecond, thereby permitting a rep rate in the megahertz range.

The recovery of the voltage-holding ability of both the HPSG and LPSG switches following discharge is hastened by blowing the seed gas through the electrode space at a velocity of about 4 cm/millisecond. Under these conditions, the switches have a maximum repetition rate of about 1 kHz. For some applications of these ETA accelerators, a faster repetition rate is desired. A switch operating near the low pd branch (pd branch as used here is defined as the gas pressure (p) times electrode spacing distance (d) as a function of the voltage holding capability) of the Paschen self-breakdown curve is expected to have faster recovery. This is because the ions and electrons resulting from a particular discharge have a mean free path through the seed gas comparable with electrode spacing, and so the ionized particles should rapidly recombine at the surfaces of the electrodes. For example, to be acceptable for ETA purposes, the triggered switch should have a fast rise time of current (on the order of 5 ns) and low jitter (having a width of the distribution of firing time delays on the order of a few ns).

This ionization rate limit is a fundamental physics limit. Ionization rate (the buildup of the density $n_p$ of the seed gas after it has been ionized in the gap between the cathode and the anode) is dependent on the current density J of the ionizing particles and their mean free path lambda ($\lambda$) for an ionization event to occur. The physics relationships are expressed in Equation 1 as follows:

$$\frac{dn_p}{dt} = J_e/\lambda_e + J_i/\lambda_i + J_o/\lambda_o \quad (1)$$

In Equation 1, the subscripts refer to the type of particle which ionizes the electrically neutral seed gas: e=electrons, i=protons (positive ions), and o=neutrals (neutral ions). The limitation on the rate (measured in density per second) at which ionization of the seed gas can occur is established by the functional energy dependence of lambda, defined as the mean free path for an ionization event to occur. Customary notation is to define mean free path lambda as equal to $1/n_g$ times sigma ($\sigma$) (E), where $n_g$=seed gas density of the seed gas that is to be ionized, and sigma times (E)=the energy-dependent "cross section"=the probability of ionization occurring in response to the incident ion species (i.e., positive, neutral or electrons) comprising the current density J (measured in units of amps per $cm^2$ of seed gas).

For the electron-triggered high voltage LPSG, only the first term ($J_e$/lambda$_e$) is operable because it is the electron current flowing between the anode and cathode which establishes the rate of ionization of the electrically neutral seed gas. As illustrated by FIG. 3, the rate of ionization is inherently limited due to the optimum value for the energy-dependent cross section (sigma times E), which for high voltage is limited to an upper limit of approximately 120 kV. Ionization rate could be greatly enhanced if the second and third terms of Equation 1 on the right hand side of the equal sign could be brought into operation; however, up until now it has not been possible to do this.

To summarize, the desirable features of a low pressure spark gap (LPSG) when compared to the high pressure spark gap (HPSG) are (1) the inherent rapid recovery of the LPSG due to fast recombination of the ionized seed gas into its electrically neutral molecular configuration, and (2) the obvious mechanical system advantage of the LPSG by greatly reduced gas pumping requirements when contrasted with the high pressure spark gap. On the other hand, the major limitations of the low pressure spark gap when compared to the high pressure spark gap are (1) the LPSG's relatively long current rise time (on the order of 10's of nanoseconds) at high voltage (around 100 kV), and (2) anode damage in the LPSG due to electron bombardment early in the discharge when the potential difference in the gap between the anode and cathode is still high (on the order of 100 kV). Both of these limitations result from the conventional electron-ionized low pressure spark gap having the characteristic of being ionization-rate limited for high voltage, typically in the range of greater than 100 volts. For the purposes of spark gaps, high voltage is considered any voltage in the range of 120 kV and above.

OBJECTS AND SUMMARY OF THE INVENTION

Accordingly, in order to resolve the problems discussed above as well as others, it is an object of this invention to provide an ion diode serving as a trigger for a low pressure spark gap.

Another object is to provide a spark gap having minimal pumping requirements to eliminate the necessity for large and cumbersome vacuum pumping equipment.

Another object is to provide an electric switch which has fast current rise and closes quickly to provide for rapid firing of short bursts of high current.

Another object is to greatly increase the peak current-carrying capability of the spark gap so that currents on the order of 100 KA can be pulsed through the spark gap.

Another object is to provide a spark gap which fires very rapidly, on the order of $10^4$ pulses/second and has an inherently quick recovery time, so the switch after firing quickly re-opens and is ready for another pulse of current.

Another object is to provide a spark gap having adequate spacing between the anode and cathode to permit high voltage operation without initiating self-breakdown (Paschen breakdown).

Additional objects, advantages and novel features of the invention will be set forth in part in the description which follows, and in part will become apparent to those skilled in the art upon examination of the following, or may be learned by practice of the invention. The objects and advantages of the invention may be realized and attained by means of the instrumentalities and combinations particularly pointed out in the appended claim.

In summary, this invention achieves the above and other objects by providing an ion diode triggered low pressure spark gap (LPSG) for use as an electric switch operating at high voltage, current and repetition rate. A housing means defines a chamber. Mounted inside the housing are means serving as cathode, anode and ion plate. During operation, pumping means introduces into and later withdraws from the housing means an ionizable fluid such as a seed gas. A power source means for energizing the ion plate supplies a pulse of current to the ion plate, causing a burst of energetic ions and neutral atoms from the ion plate. The ions and atoms move into and ionize the fluid. A means for energizing the anode is connected to and supplies an electric current to the anode. In the presence of the now ionized fluid, the anode current discharges, pulses through the ionized fluid, and makes electrical contact with the cathode. The ion plate and anode are thereby de-energized, causing current to stop flowing from anode to cathode. The LPSG quickly recovers as the ionized fluid recombines into its initial ionizable state. The switch is now "open" and ready for another cycle.

The novel features of the invention are set forth with particularity in the appended Claims. The invention will best be understood from the example set forth in the following description when read in conjunction with the accompanying drawings.

BRIEF DESCRIPTION OF THE DRAWINGS

The accompanying drawings, which are incorporated and form a part of the specification, illustrate an embodiment of the invention and, together with the description, serve to explain the principles of the invention. In the drawings.

DETAILED DESCRIPTION OF A PREFERRED EMBODIMENT

Figure 1:
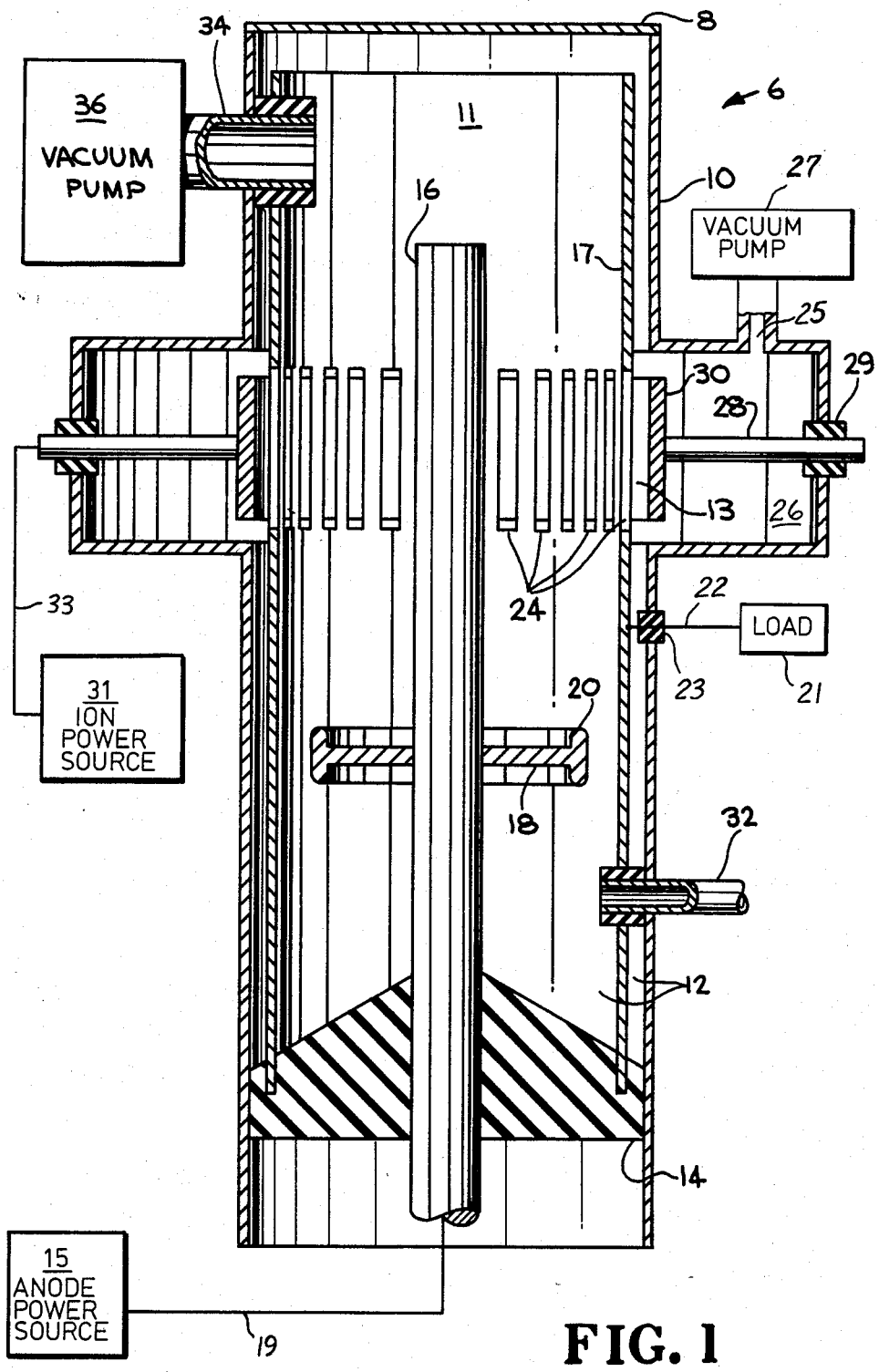
FIG. 1 is a side elevation cross section of an ion diode-triggered spark gap schematic according to the invention.
Figure 2:
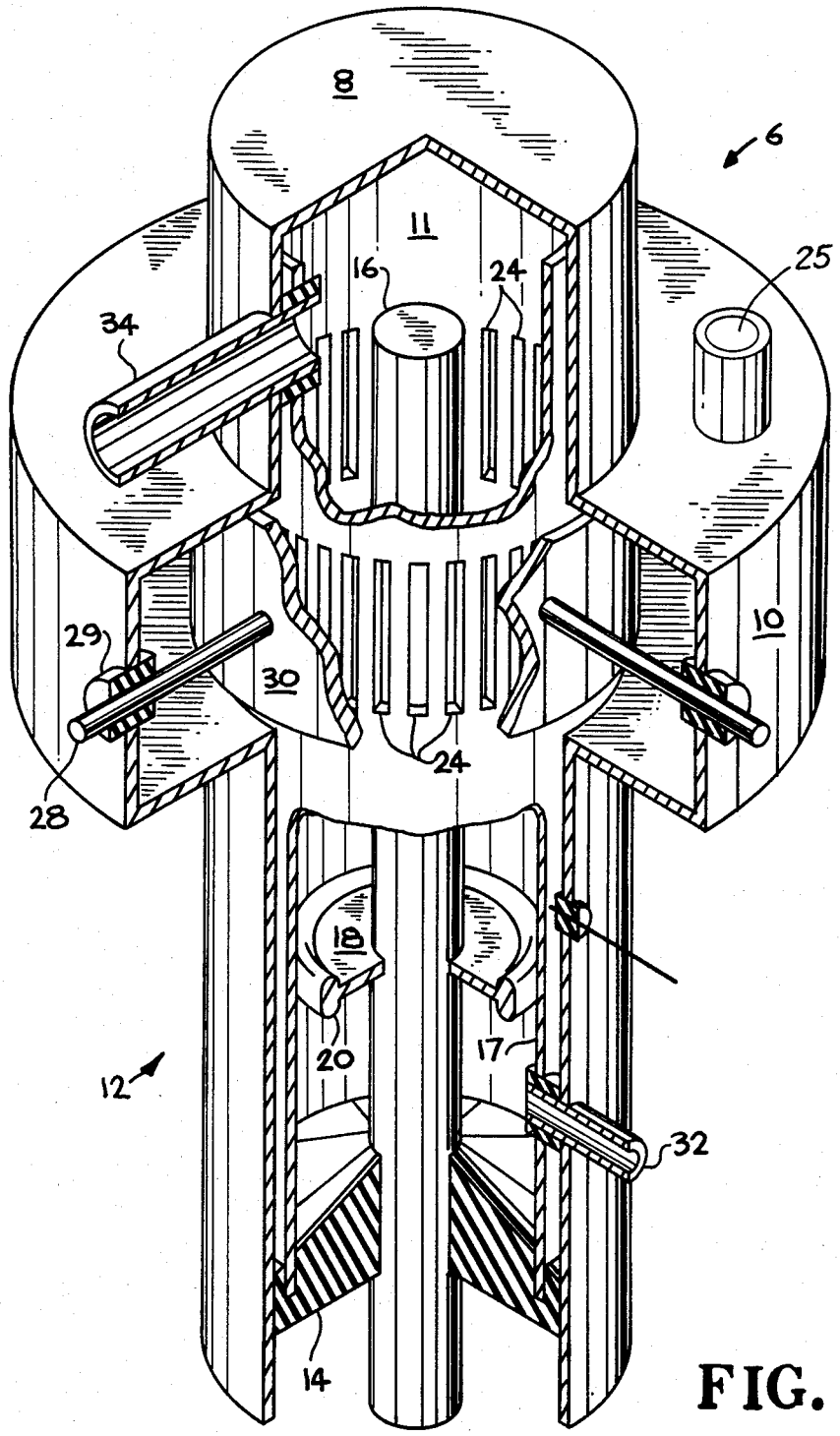
FIG. 2 is a partial cut-away orthogonal view of the spark gap of FIG. 1 according to the invention.

FIG. 1 illustrates a suggested construction as an example of a preferred apparatus using this invention to achieve optimum performance in accordance with the claims. Housing means such as housing 6 is formed by fixing housing top 8 to housing wall 10 which is in turn mounted on housing base 14. Chamber 12 is defined inside this housing 6. In this example, chamber 12 has a cylindrical shape, although other geometries could be employed; for example, chamber 12 could have the shape of a rectangular prism. Housing 6 is constructed of a rigid material such as aluminum or stainless steel having sufficient rigidity to withstand vacuum pressures of 100 microns; this is the pressure which commonly exists inside chamber 12 during operation of the apparatus. Dimensions of the cylindrical spark gap apparatus to be fabricated and tested are as follows: 10 inch outside diameter (OD) for housing top 8, 16 inch OD for plate chamber 26, and an overall height of 16 inches as measured from the top to the bottom of housing wall 10. Housing base 14 is constructed of a dielectric material which is rigid; suitable materials include epoxy or Lexan-Plastic. Another possible configuration of base 14 is to use an electrical conductor such as a metal, but this would require housing base 14 to be electrically insulated from housing wall 10 and the other parts discussed below.

Mounted in and penetrating housing base 14 is an anode means such as anode 16, which protrudes into chamber 12 and has a generally cylindrical shape although not necessarily so. In this preferred embodiment, anode 16 has dimensions of approximately 2.54 centimeter diameter and a height of approximately 15 centimeters. Anode 16 is an electrical conductor made of such materials as stainless steel or brass. Attached to and encircling anode 16 is disk 18, constructed of such materials as stainless steel or brass and functioning as a baffle to shield housing base 14 from the anode 16 electrical discharge. Disk 18 terminates at lip 20; lip 20 serves as a corona suppression ring and is made of such materials as stainless steel or brass. Anode 16 is electrically connected to an anode power source 15 which is external to the apparatus shown in FIG. 1 and capable of supplying electrical current and voltage to anode 16.

Mounted inside housing 6 is a cathode means such as cathode 17, which has a cylindrical shape, is coaxial with housing 6 and anode 16, and is provided with a plurality of emission ports 24. Cathode 17 is electrically connected to load 21 through load lead 22, which penetrates housing wall 10 through load insulation 23 provided in wall 10.

Penetrating housing wall 10 is plate support 28, consisting of a rigid material such as stainless steel, capable of conducting electricity, electrically insulated from housing wall 10 by plate insulation 29 and electrically connected to an external ion plate power source 31. Plate support 28 is aligned generally perpendicular to housing wall 10 and extends toward the anode 16, but stops before reaching cathode 17. Mounted at the terminus of plate support 28 is an ion plate means such as ion plate 30, aligned to be generally perpendicular to plate support 28, generally parallel to housing wall 10 and cathode 17, and mounted behind emission ports 24.

Ion plate 30 extends circumferentially around chamber 12, and is concentric with it. Ion plate 30 is to be fabricated from ion-emitting materials such as surface plasma discharge boards, lucite, polyethylene, hydrocarbon-plastics filaments or other materials capable of emitting positive ions upon application of a high voltage pulse from the ion plate power source 31 through the plate support 28 to the ion plate 30. Plate chamber 26 is concentric with housing 6, is defined by the outward expansion of housing wall 10 as shown in FIG. 1, and houses ion plate 30.

Plate chamber pump 27 is in fluid communication with plate chamber 26 through exhaust port 25, and serves to create and maintain a vacuum pressure in plate chamber 26 and trigger cavity 13. Vacuum pump 36 and plate chamber pump 27 are adjusted relative to one another so as to maintain a pressure differential between central cavity 11 and the combination of plate chamber 26 and trigger cavity 13. Central cavity 11 is maintained at a higher pressure (preferably in the 10 to 100 micron range) than the combination of trigger cavity 13 and plate chamber 26 (preferably in the 1 to 3 micron range).

Provided in wall 10 is inlet 32, through which suitable ionizable fluid such as seed gas mixtures (not shown) are introduced into chamber 12. Example seed gases will preferably have good dielectric properties, such as hydrocarbons, sulfur fluoride, argon and the like. Provided in housing wall 10 toward the top of chamber 12 is outlet 34 in fluid connection with pumping means such as an external vacuum pump 36. In the chamber 12, trigger cavity 13 is defined in the space between ion plate 30 and cathode 17; central cavity 11 is defined inside the shell comprising cathode 17. Vacuum pump 36 serves at least the two functions of: (1) maintaing a "dynamic" (i.e., continuous) flow of the seed gas through housing 6 while holding housing 6 at vacuum pressures on the order of $10^{-6}$ torr, and (2) creating and maintaining a pressure differential between central cavity 11 (which is the high pressure region) and the combination of trigger cavity 13 and plate chamber 26 (which is the low pressure region).

During operation, the spark gap of this preferred embodiment is designed to operate at approximately 1000 pulses or cycles per second. Each pulse or cycle will occur in a sequence of steps. First, the ionizable fluid such as the seed gas (not shown) is introduced through inlet 32 into chamber 12, central cavity 11, and trigger cavity 13, to exit through outlet 34. Simultaneously with this, vacuum pump 36 is activated to create and maintain dynamic flow of the seed gas through the apparatus.

Second, anode power source 15 is energized with a current on the order of 100 kA and a voltage on the order of 250 kV. For the spark gap of this invention, anode power source 15 comprises the conventional arrangement of a 50 amp high voltage direct current source, connected in series with an isolation resistor or inductor, connected in series to a capacitive element such as a Blumlein; none of these elements is shown, but instead are collectively represented schematically as anode power source 15. Anode power source 15 experiences a relatively slow charging cycle, on the order of approximately 1 millisecond, to finally store a charge on the Blumlein (not shown) with a potential of 250 kV. Anode lead 19 connects the now charged anode power source 15 to anode 16 so anode 16 is poised to discharge across the gap separating cathode 17 from anode 16. However, enough distance separates anode 16 from cathode 17 to prevent an undesired short circuit from anode 16 across the gap to cathode 17 (i.e., Paschen breakdown).

Third, ion plate 30 is electrically energized through ion lead 33 from a means such as ion power source 31, this electrical energy taking the form of a pulse on the order of 150 kV with a current of 10 kA. Ion power source 31 for this apparatus comprises a conventional positive pulsed power supply such as a thyratron switch capable of discharging 10 kV in 10 nanoseconds.

Fourth, ion plate 30, upon being energized, emits a burst of atomic particle species including positive ions as well as energetic neutral atoms. These particles move toward cathode 17, pass through emission ports 24, and enter central cavity 11. The positive ions ionize the seed gas, thereby making the seed gas capable of conducting an electric current. Sufficient ionization occurs to permit the electric charge held in anode 16 to flow as current across the distance separating anode 16 from cathode 17. The current connects with cathode 17 and thereby completes the circuit for current flow from anode 16 to cathode 17. As mentioned above, the central cavity 11 throughout this operation is kept at a constant vacuum on the order of 100 microns by keeping central cavity 11 in fluid communication through outlet 34 with external vacuum pump 36.

Fifth, when the anode power source 15 has discharged, the current in the apparatus stops flowing. The low pressure ionized seed gas can quickly recombine back to an electrically neutral gas again serving as a dielectric. The anode power source 15 can be recharged now that the switch is "open". The apparatus has now completed one full cycle, and is ready to be operated again. The apparatus is designed to operate at repetition rates of $10^4$ pulses per second, discharge rapidly (on the order of 1 microsecond), and deliver current on the order of tens of thousands of amps.

As indicated, the ion plate 30 is an ion trigger which supplies an energetic ion burst as well as a copious amounts of energetic neutral atoms. The neutral atoms also ionize the seed gas. As discussed above, the use of positive ions in place of electrons as the ionization mechanism for spark gaps offers several advantages. First, positive ions are capable of producing much more powerful and much faster ionization rates (at 100 keV, ions are approximately $10^3$ times more efficient ionizers than electrons). Second, because of the greater energy of the positive ions (energy around 150 KeV), it is possible to achieve far greater bulk volume ionization of the electrically neutral seed gas. That is, the ions travel far into the seed gas before the ions' forward velocity is reduced to the point where the ions no longer efficiently ionize the seed gas. Electrons, however, only efficiently ionize very near the cathode where the electron's energy is 100 eV. Third, the ion plate generating the "puff" of positive ions simultaneously emits a high density energetic neutral atom burst. These neutral atoms will also ionize the seed gas in the chamber, thereby increasing the density of ion species capable of ionizing the seed gas, thus permitting the use of a low density of seed gas (on the order of approximately 10 microns, instead of 100 microns). The energetic neutral atoms also cooperate with the positive ions to provide a low pressure spark gap having a very fast recovery rate (on the order of 1 microsecond), because the neutral atoms serve to further reduce the required seed gas pressure.

Figure 3:
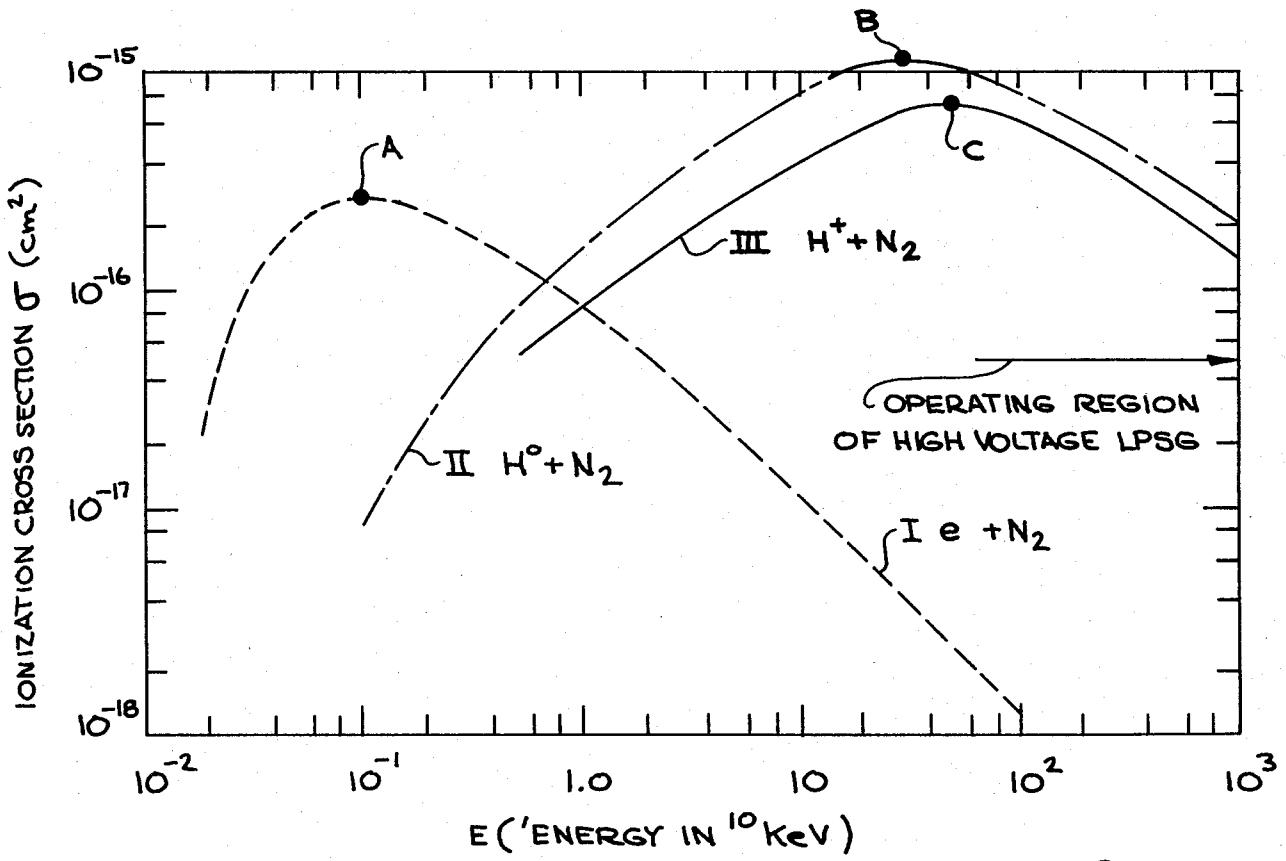
FIG. 3 is a graph showing the relationship between the ionization cross section sigma in $cm^2$ and the energy of the incident atomic particle species (electrons, ions or neutral atoms) which ionize the fluid such as a seed gas (which in this example is specified as nitrogen $N_2$). The cross section sigma is a measure of the probability or likelihood of an ionization event occuring.

FIG. 3 shows the energy dependence of the ionization cross section sigma on the energy (E) of all three species of particles (energetic electrons, positive ions, and neutral atoms) which ionize a gas, consisting in this example of molecular nitrogen. These curves differ slightly for different seed gases (i.e. oxygen, argon, etc), but the quantitative features are similar. Curve I is for electrons (e), Curve II is for electrically neutral hydrogen atoms ($H^o$), and Curve III is for electrically positive hydrogen ions ($H^+$). For the electrons of Curve I, Point A shows the maximum ionization energy to be 0.10 keV (thousand electron volts). For the electrically neutral hydrogen atoms at Curve II Point B and the electrically positive hydrogen atoms at Curve III Point C, the maximum ionization energy for both is seen to be close to 100 keV. The important distinction among the three species shown on FIG. 3 is that only at low energies do electrons efficiently ionize the seed gas through which it is moving. In contrast, the positive ions and neutral atoms efficiently ionize over a broad range of high energies (from 10 up to 200 keV). The LPSG of this invention takes advantage of these high energy particle species.

The foregoing description of a preferred embodiment of the invention has been presented for purposes of illustration and description. It is not intended to be exhaustive or to limit the invention to the precise form disclosed, and obviously many modifications and variations are possible in light of the above teaching. The embodiment was chosen and described in order to best explain the principles of the invention and its practical application to thereby enable others skilled in the art to best utilize the invention in various embodiments and with various modifications as are suited to the particular use contemplated. It is intended that the scope of the invention be defined by the attached claims.

I claim:

1. Spark gap apparatus comprising:

(a) housing means defining a chamber wherein said chamber is provided with a high pressure region and a low pressure region, such that said fluid enters said chamber in said high pressure region before exiting said chamber and said housing;

(b) anode means mounted inside said housing means in the high pressure region;

(c) ion plate means mounted inside said housing means in the low pressure region;

(d) pumping means for introducing into and withdrawing from said housing a fluid capable of being ionized;

(e) power source means for energizing said ion plate means, causing said ion plate means to emit positive ions to ionize said fluid so said fluid is capable of conducting electric current;

(f) means for connecting said anode means with electric current source means capable of providing electric current to said anode means; and (g) cathode means mounted inside said housing means such that said cathode means separates said high and low pressure regions, and said cathode means being further provided with emission ports which permit the passage of said positive ions therethrough.

2. The spark gap according to claim 1, wherein said chamber is provided with a high pressure region and a low pressure region, such that said fluid enters said chamber in said high pressure region and then travels to said low pressure region before exiting said chamber and said housing.

3. The spark gap according to claim 2, wherein said ion plate means is mounted in said low pressure region.

4. The spark gap according to claim 1, wherein said pumping means provides continuous flow of said fluid.

5. The spark gap according to claim 1, wherein said fluid is electrically neutral prior to being ionized.

6. The spark gap according to claim 1, wherein said fluid comprises a gas.

7. The spark gap according to claim 6, wherein said fluid is $SF_6$ gas.

8. The spark gap according to claim 1, wherein said housing means, cathode means, anode means and ion plate means are all electrically insulated from one another.

* * * * *